United States Patent [19]

Foster et al.

[11] 4,433,497

[45] Feb. 28, 1984

[54] IRON AND IRONING BOARD SUPPORT

[75] Inventors: Edwin E. Foster; Wilbur A. Foster; Thomas E. Foster, all of Austin, Tex.

[73] Assignee: Majik-Ironers, Inc., Austin, Tex.

[21] Appl. No.: 336,847

[22] Filed: Jan. 4, 1982

[51] Int. Cl.[3] ..... D06F 71/00

[52] U.S. Cl. ..... 38/107

[58] Field of Search ..... 38/30, 107, 104, 103, 38/139, 112, 31; 108/28, 50

[56] References Cited

U.S. PATENT DOCUMENTS 3,303,591 11/1965 Foster .
3,699,673 10/1972 Foster et al. .
3,862,503 1/1975 Foster et al. .

*Primary Examiner*—Werner H. Schroeder
*Assistant Examiner*—Andrew M. Falik
*Attorney, Agent, or Firm*—Kalish & Gilster

[57] ABSTRACT

Compact, collapsible ironing apparatus is disclosed having a base providing supportive disposition upon a supporting surface for carrying an ironing board and for supporting a hand iron above the ironing surface of the ironing board. A first upright member extends upwardly from the base and is pivotally secured at its upper end to the ironing board for swingable movement upon a pivot axis between storage and use positions. A second upright member extends upwardly from the base and an iron support linkage is swingably interconnected at one end to the upper end of this second upright member. The linkage comprises articulated arms which are extendable to positions over the ironing surface. An iron securement unit pivotally interconnects the distal end of the support linkage with the iron for permitting movement of the iron between first and second orientations respectively in and out of contact with the ironing surface. The base includes folding leg members movable between storage and use positions conjointly with swinging movement of the ironing board between its respective storage and use positions.

12 Claims, 21 Drawing Figures

IRON AND IRONING BOARD SUPPORT

BACKGROUND AND SUMMARY OF THE INVENTION

This invention relates in general to ironing equipment and, more particularly, to a compact, collapsible ironing apparatus including means for automatic iron lifting.

This invention constitutes an improvement of the ironing apparatus set forth in Foster U.S. Pat. No. 3,303,591, issued Feb. 14, 1967, and U.S. Pat. application Ser. No. 255,888, filed Apr. 20, 1981.

It is an object of the present invention to provide ironing apparatus which compactly and unitarily comprises an iron, support linkage therefor, and means for supporting and securing an ironing board in conjunction with the support linkage and wherein the iron is supported in a configuration for providing extremely facile handling during ironing operations.

It is another object of the invention to provide such ironing apparatus which is of a folding nature for providing extremely compact configuration, when folded, requiring minimum storage space during disuse.

Another object of the invention is the provision of such apparatus which includes an ironing board and support means therefor which are readily movable between storage and use orientations and are of collapsible configuration.

It is a further object of the present invention to provide compact, collapsible ironing apparatus of the type stated including an ironing board easily movable between storage and use position, and which further includes a support arrangement including legs which extend automatically in response to movement of the ironing board to its use position.

It is another object of the present invention to provide such ironing apparatus which is lightweight so as to be amenable to easy handling by even a small person, yet which provides extremely simple installation, unfolding and set-up for ready use, and subsequent folding for storage.

Another object of the present invention is the provision of such ironing apparatus which incorporates automatic iron supporting means so that, upon termination of any ironing movement for whatever purpose, such as for changing the work, shifting same on the board, etc., the iron is configurable in a position lifted above the board, thereby sparing the user the heretofore tedious and laborious procedure of carrying the iron to a resting place and returning same to the work.

A further object of the invention is the provision of such apparatus for providing a lifting force for the iron for resort to heavy manual lifting of the iron, and which lifting force facilitates the raising of the iron from an ironing board surface on which it is located during ironing.

It is a further object of the present invention to provide such ironing apparatus which includes provision for causing the iron to be restrained against movement, floating, or shifting if manually released when in a position lifted above the board, so that the iron will remain poised with relation to the work as presented by the user in readiness for resuming ironing operations.

A further object of the present invention is to provide such ironing apparatus which maintains components in operative condition to avoid any inadvertent, accidental or premature collapsing and yet disposing such components for easy, selective return to collapsed, stored condition.

A still further object of the present invention is to provide such ironing apparatus which includes a foot-operated arrangement for selectively releasing the mechanism to permit movement between use and storage positions.

A further object of the invention is the provision of such ironing apparatus which, upon termination of ironing operations, allows the iron to be stored while still hot without danger to persons or apparatus.

Among further objects of the present invention are the provisions of such ironing apparatus which is of simplified, economical construction, providing but few simple parts fabricated of durable materials to render the apparatus resistant to failure and breakdown; which is economical in production; which is extremely reliable in usage; and which eliminates the heretofore accepted inconvenience associated with the storing of ironing boards and ironers.

Yet another object of the invention is the provision of such ironing apparatus which may be used in conjunction with a conventional ironing board if desired, and without requiring modification of the ironing board.

It is a still further object of the present invention to provide such ironing apparatus which can be used with virtually any selected type of conventional dry or steam type iron of the hand-held variety; being amenable to facile securement to, and lifting of, irons of various different manufacturers, yet without requiring modification of the iron.

It is another object of the present invention to provide such ironing apparatus including an ironing board which is reliably maintained in its storage position until moved deliberately therefrom by the user.

Another object of the invention is the provision of such ironing apparatus which is easily transported, when its components are in collapsed, storage orientation, from place to place by rolling across a floor surface.

Other objects will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 3:
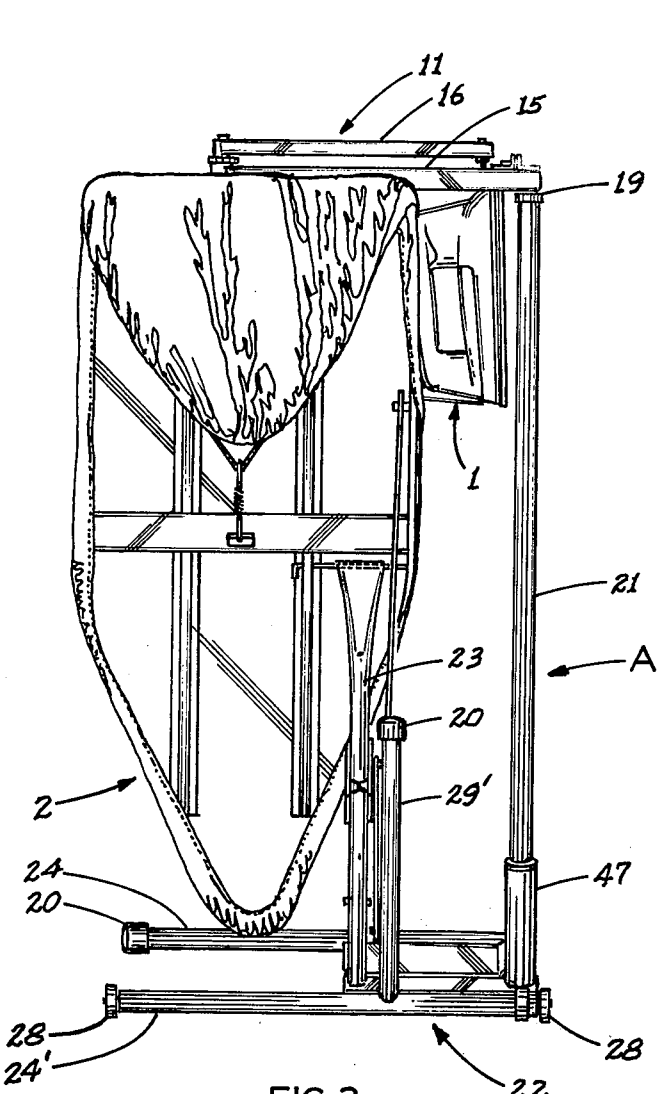
FIG. 3 is a side elevation, from the opposite side, of apparatus of FIG. 1.

Referring now by reference characters to the drawings, A designates generally a preferred embodiment of compact, collapsible ironing apparatus of the invention intended to so greatly facilitate ironing of the type heretofore carried out with a conventional hand type iron that it provides hitherto unrealized ease of ironing, attaining nearly effortless ironing in domestic use yet allowing utilization of commercially available hand type steam irons, e.g., as generally designated 1, representative of many domestic or commercial hand irons presently available in the market.

Figure 2:
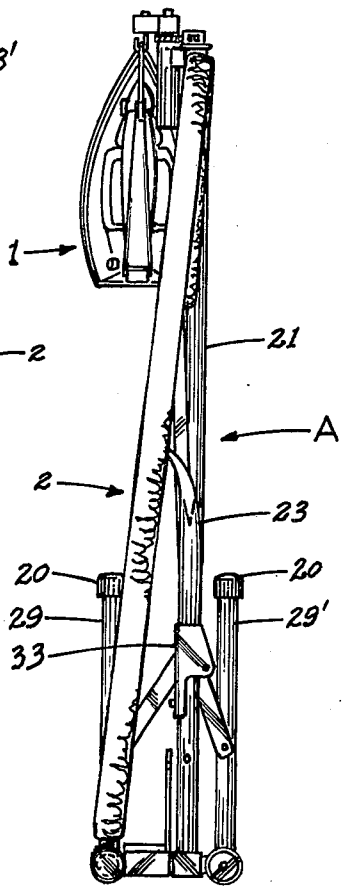
FIG. 2 is a front elevation of the apparatus of FIG. 1.
Figure 1:
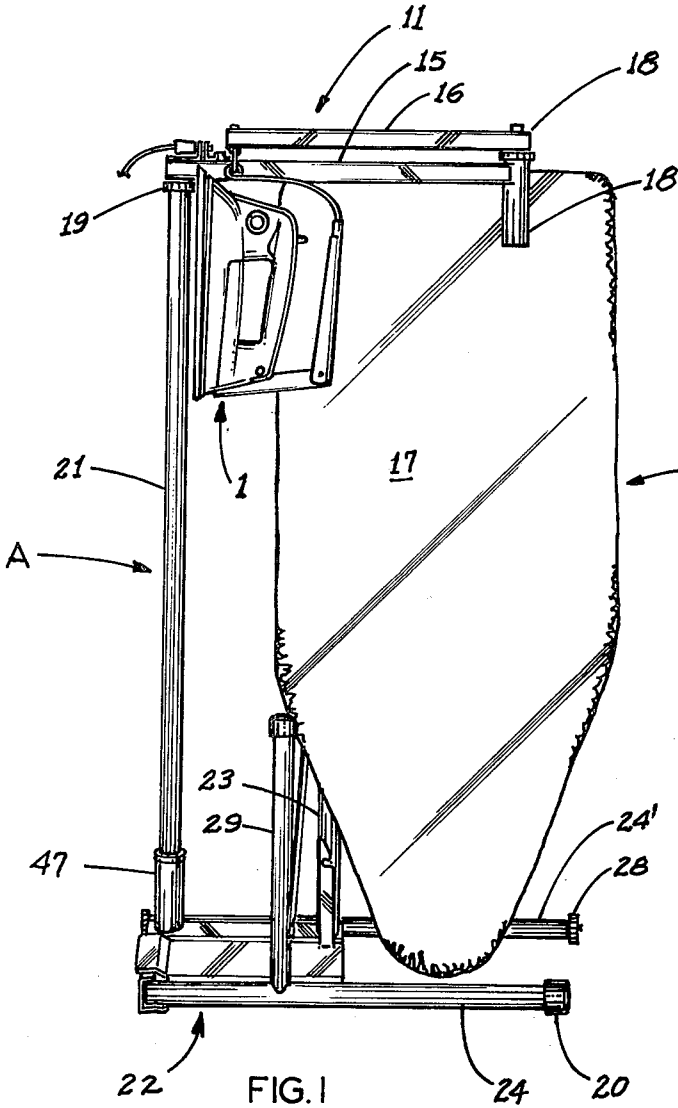
FIG. 1 is a side elevation of ironing apparatus, including an ironing board, such ironing board being shown in stored position, as constructed in accordance with and embodying the present invention.

In FIGS. 1-3, apparatus A is shown in a collapsed or folded state, being thus rendered very compact, for permitting storage with all elements positioned to occupy minimum volumetric space such as will permit the entire apparatus to be placed in a closet or other confined space yet in full readiness for being almost instantaneously returned to a position of readiness for use. Thus, in FIGS. 6 and 7, the new ironing apparatus is shown with its various mechanisms having been reconfigured with all elements deployed for initiating the ironing operation.

Figure 6:
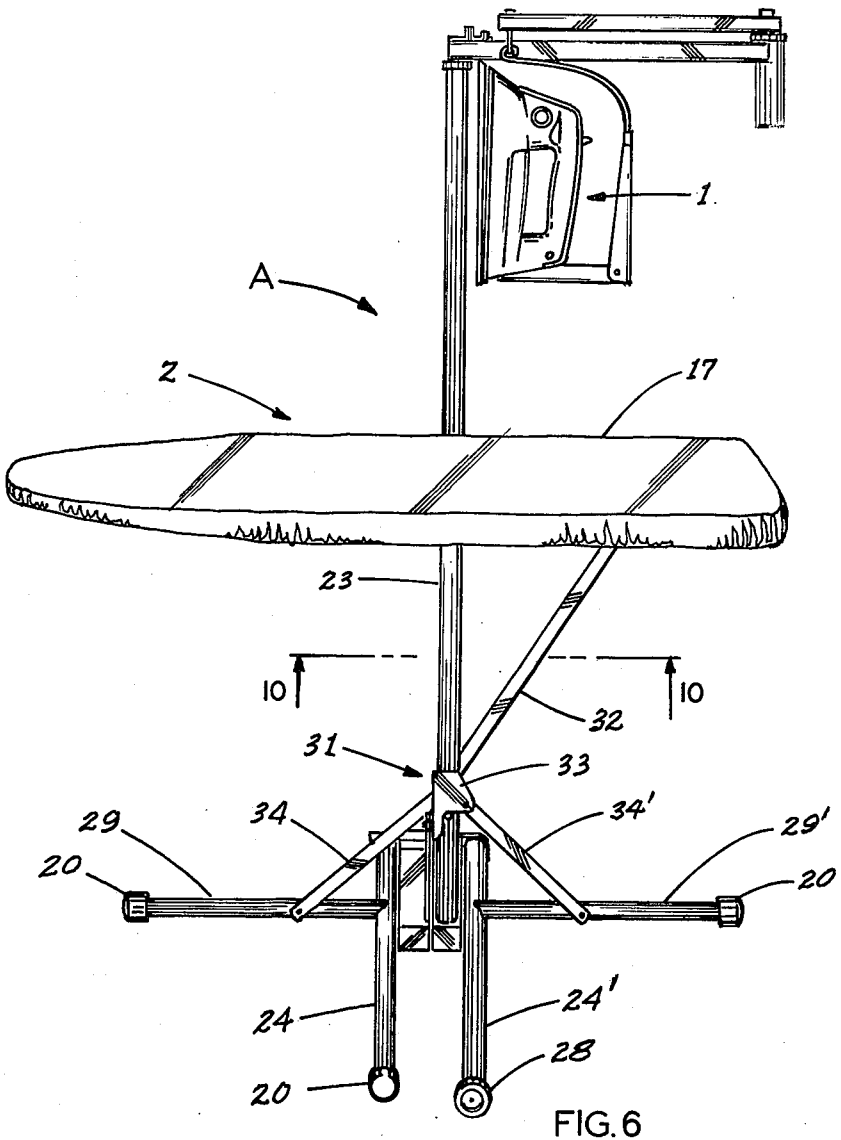
FIG. 6 is a front perspective view of ironing apparatus of the invention as oriented for use and with certain iron support elements of the apparatus being shown in their use position but prior to disposition of the iron for use.
Figure 7:
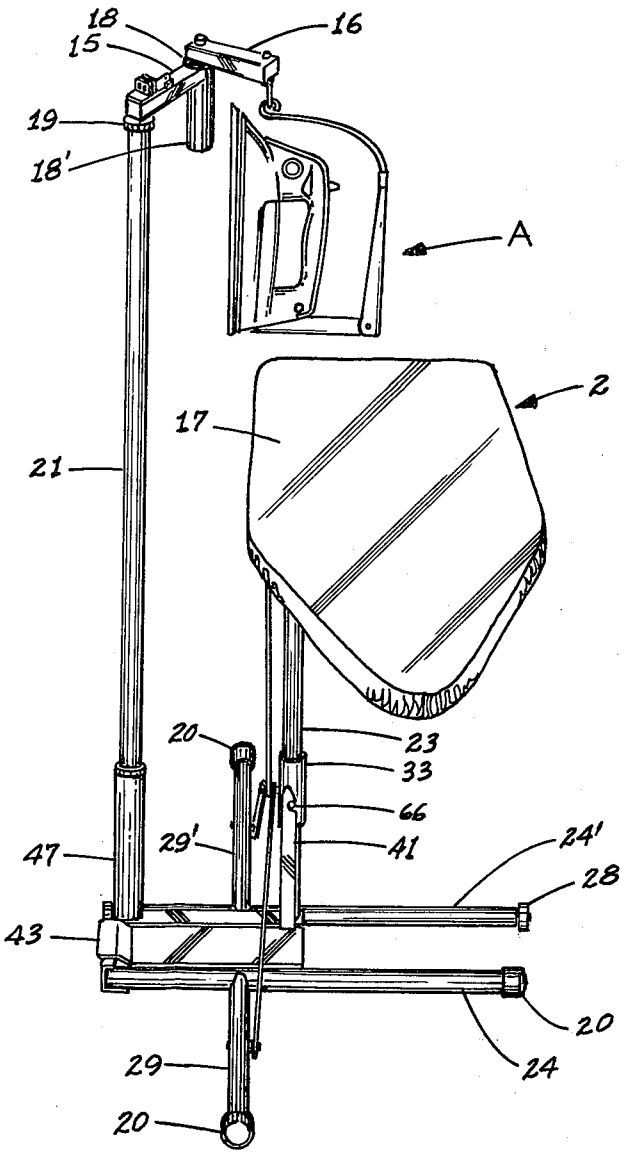
FIG. 7 is a perspective view, from the side, of the new apparatus with the elements in the same positions as depicted in FIG. 6.

In addition to iron 1, there is provided an ironing board designated generally 2 which is adapted to swing between a storage position shown in FIGS. 1-3 and use position shown in FIGS. 6 and 7.

Figure 19:
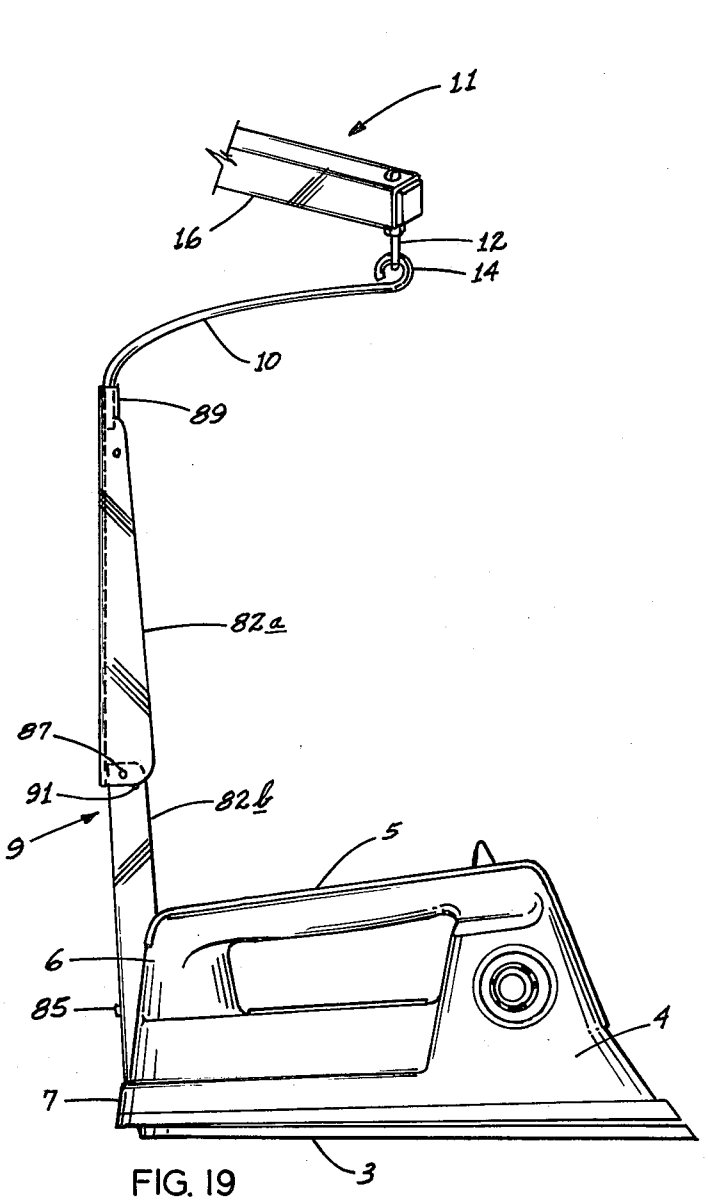
FIG. 19 is a side elevation of the iron and support structure therefor, with the iron in a use position.
Figure 20:
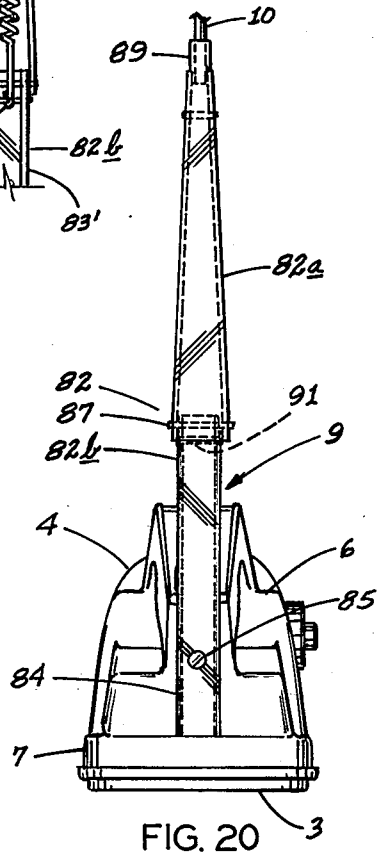
FIG. 20 is a rear view of the spring-loaded securement device as secured to the iron and with the iron in use position.
Figure 18:
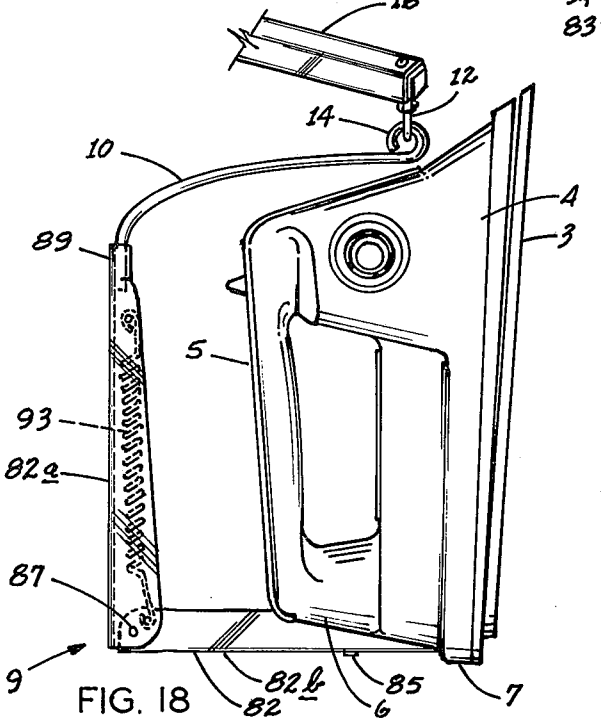
FIG. 18 is a side view elevation of certain portions of an iron lifting mechanism of the invention, including a spring-loaded securement device which provides interengagement with a standard hand-held steam iron and support structure therefor, the iron being shown in a lifted position.

Referring particularly to FIGS. 18-20, iron 1 has the usual sole plate 3 and body 4 having a hand grip 5 which may optionally include a spray nozzle but typically having a rear portion 6 of increased thickness and merging into a base or heel 7 on which the iron may be seated in an upright position if used conventionally apart from the new apparatus.

Connected to iron 1 is a securement or terminal device, or unit, designated generally 9 which is connected by a rod 10 which may be termed a support arm extension by which the iron is to be supported and interconnected with a support linkage designated generally in its entirety at 11. Said linkage includes a downwardly depending hook 12 having a projection over which is fitted a swivel eye 14 formed at the upper end of rod 10 and permitting rod 10 to freely swivel about two axis of rotation which are at right angles to each other and are defined by hook member 12.

Iron support linkage 11 comprises articulated first and second arm members 15, 16 each swingable within a horizontal plane above the ironing surface 17 of ironing board 2 when the latter is in the use position demonstrated in FIGS. 6 and 7. For this purpose, arm 16 is interconnected with arm 15 by a swivel joint 18 including tubular housing 18' having bearings therein to provide a strong, secure coupling having very low friction. Arm 15 is, however, interconnected at its proximal end by a fixed connection 19 to a rotatable upright member 21 for permitting substantial weight to be applied by arm 15 when the linkage is extended yet with extremely low friction. Thus, sleeve-type bearings may be used at coupling 18.

Arms 15, 16 are preferably of tubular construction, as of steel tubing having rectangular cross section. Linkage 11 is carried at the upper end of tubular upright member 21 which extends upwardly from the rear of a base designated in its entirety generally at 22. Member 21 is vertically oriented according to the preferred construction. Extending upwardly from the front of base 22 is a shorter tubular upright member 23 which is curved slightly to the left, as seen in FIG. 2, at its upper extremity with respect to vertical. Pivotally secured to the upper end of member 23 is ironing board 2, as discussed hereinbelow. Base 22, its components, and members 21, 23 are all preferably of steel tubing. Protective rubber or plastic caps, as at 20, are fitted over the free ends of various tubular members of the base. An arrangement permitting rotation of member 21 about its axis of elongation is explained later.

Referring to FIGS. 6 and 7, base 22 is formed primarily of two tubular support members 24, 24' which are interconnected at the rear by bracket-like members 25 and forwardly by a rod 26 (FIG. 16), the latter extending through a beam 27 upon which stand upright members 21, 23. Said support members 24, 24' extend forwardly from rod 26 to provide extensions beneath ironing board 2 for stable support. Members 24, 24' are free to rotate in bracket 25 and relative to rod 26, as will be soon clarified. At opposite ends of member 24' are rotatable caster wheels 28 by which the apparatus when folded may be rolled easily across a floor surface.

Figure 5:
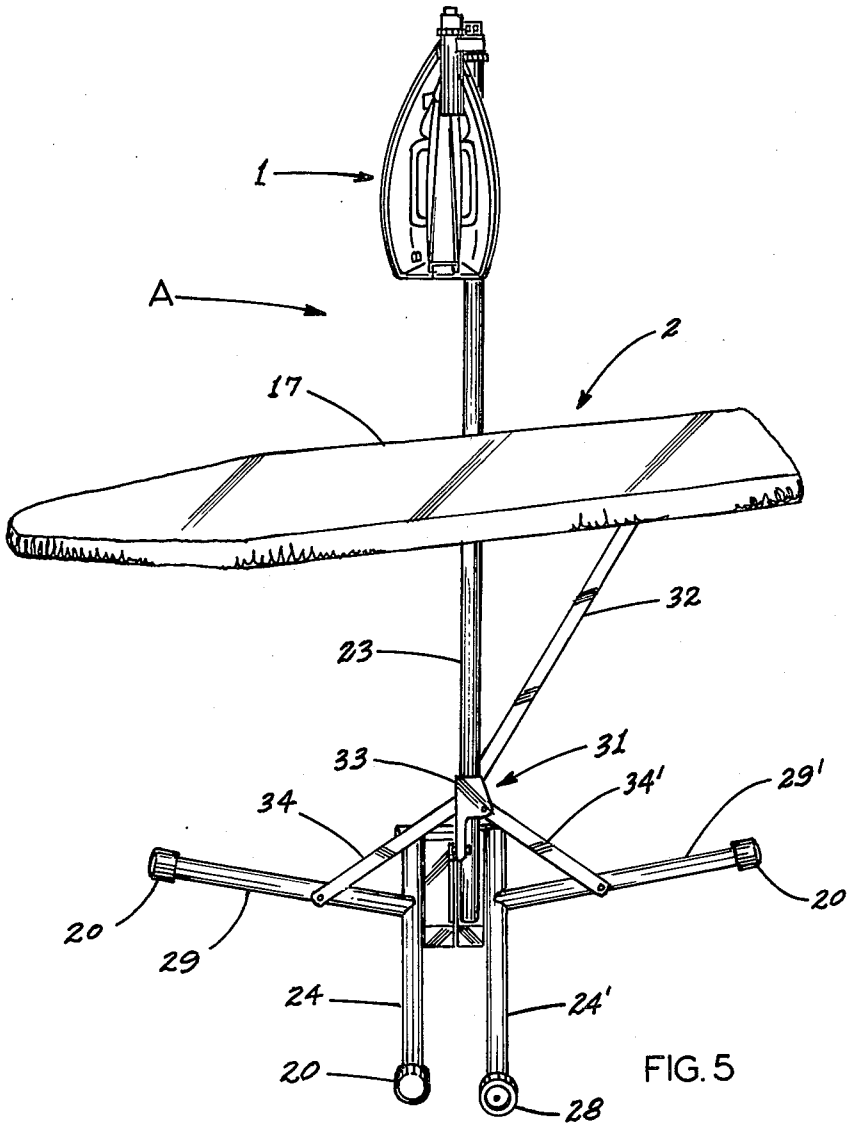
FIG. 5 is a similar perspective view of the apparatus when the elements are nearly in use position.
Figure 4:
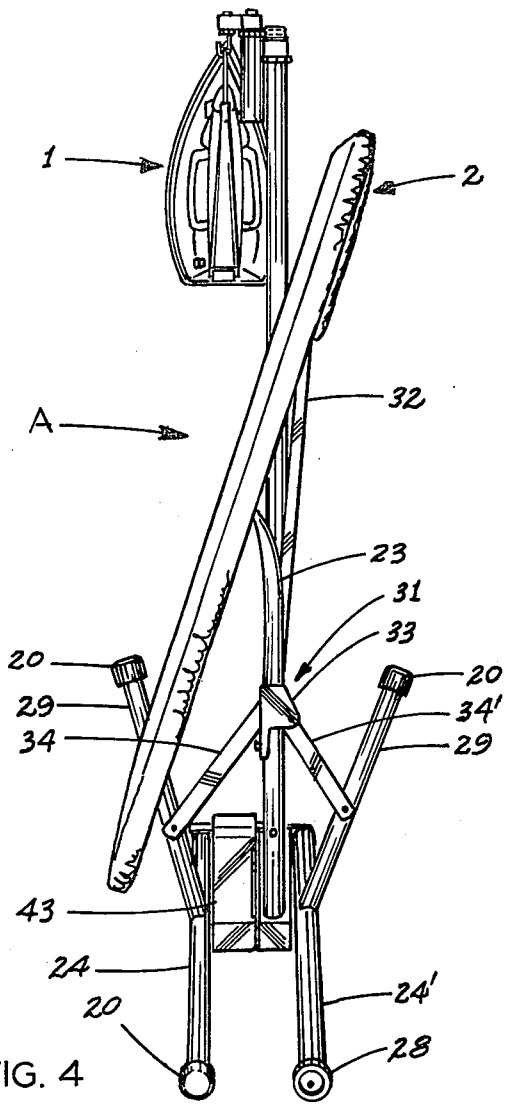
FIG. 4 is a front perspective view of the new ironing apparatus illustrating movement of elements when first being oriented, for use.

Extending radially from members 24, 24' are respective leg members or extensions 29, 29' which are each swingable in a vertical plane on a horizontal transversely oriented pivot axis defined by rotation of members 24, 24', permitting extensions 29, 29', which are thus swingably affixed, to move, as shown in FIGS. 4 and 5, between respective raised positions (FIGS. 1–3) for storage and extended positions (FIGS. 6 and 7) for use. In the extended positions, extensions 29, 29' provide greatly widened area of contact of base 22 with the floor or other supporting surface upon which the base provides supportive disposition of the apparatus.

Such movement of leg members 29, 29'causes them to be extended in opposite directions from base 22 and with them being substantially aligned with the longitudinal axis of ironing board 17 and underlying the same, thus, enhancing the side-to-side stability of the apparatus, as viewed in FIG. 6. Such movement of leg members 29, 29'is controlled by a swing control linkage, designated generally 31, interconnected with ironing board 2 by means of an arm 32 pivotally attached to the underside thereof. Such linkage causes the legs to be extended (FIGS. 6 and 7) upon movement of ironing board 17 from its storage position (FIGS. 1–3) to its use position. For this purpose, there is provided a sleeve 33 which is slidable upon upright member 23 and with linkage 31 including first and second links 34, 34' interconnecting sleeve 33 with the respective leg members 29, 29'. Arm 32 interconnects link 34' with ironing board 2 at a location radially spaced from a point of its pivotal securement to upright member 23.

Figure 10:
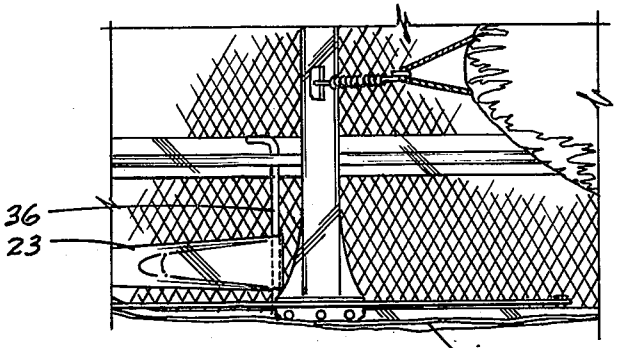
FIG. 10 is a fragmentary bottom view of certain ironing board mounting features of the invention, as taken along line 10—10 of FIG. 6.

Referring to FIG. 10, the upper end of ironing board support member 23 is connected to ironing board 2 by a shaft 36 which extends between longitudinal ribs of the ironing board whereby the latter is free to rotate on an axis at right angles to member 23 for movement between storage and use positions.

Referring now to FIGS. 8–12 and 15–17, the construction of the base and its various elements are more clearly revealed. Rod 26 is, in effect, a cross shaft for maintaining members 24, 24' in spaced relationship. This shaft is threaded at its opposite ends into plastic plugs, as at 37 in FIG. 16, which are secured to the shaft by set screws, e.g., 38. Each said plug being free to rotate within the corresponding member 24, 24' and with slots, as at 40, being provided for this purpose in each of members 24, 24'. Accordingly, legs 29, 29' may revolve through an angle of about 95°. Rockably affixed, relative to shaft or rod 26 is a tension latch member 41 by virtue of its securement by welding to a U-shaped latch release member 43 which extends rearwardly from the base for permitting the user to exert foot pressure for release of latch member 1. Release lever 43 is held in its level position prior to release by a spring wire 44 secured to base member 25. Release lever 43 extends rearwardly from a L-section member 46 which conforms to shaft 26 whereby release lever 43 may pivot around the axis of shaft 26 for moving latch member 41 rearwardly as viewed in FIG. 15.

Figure 16:
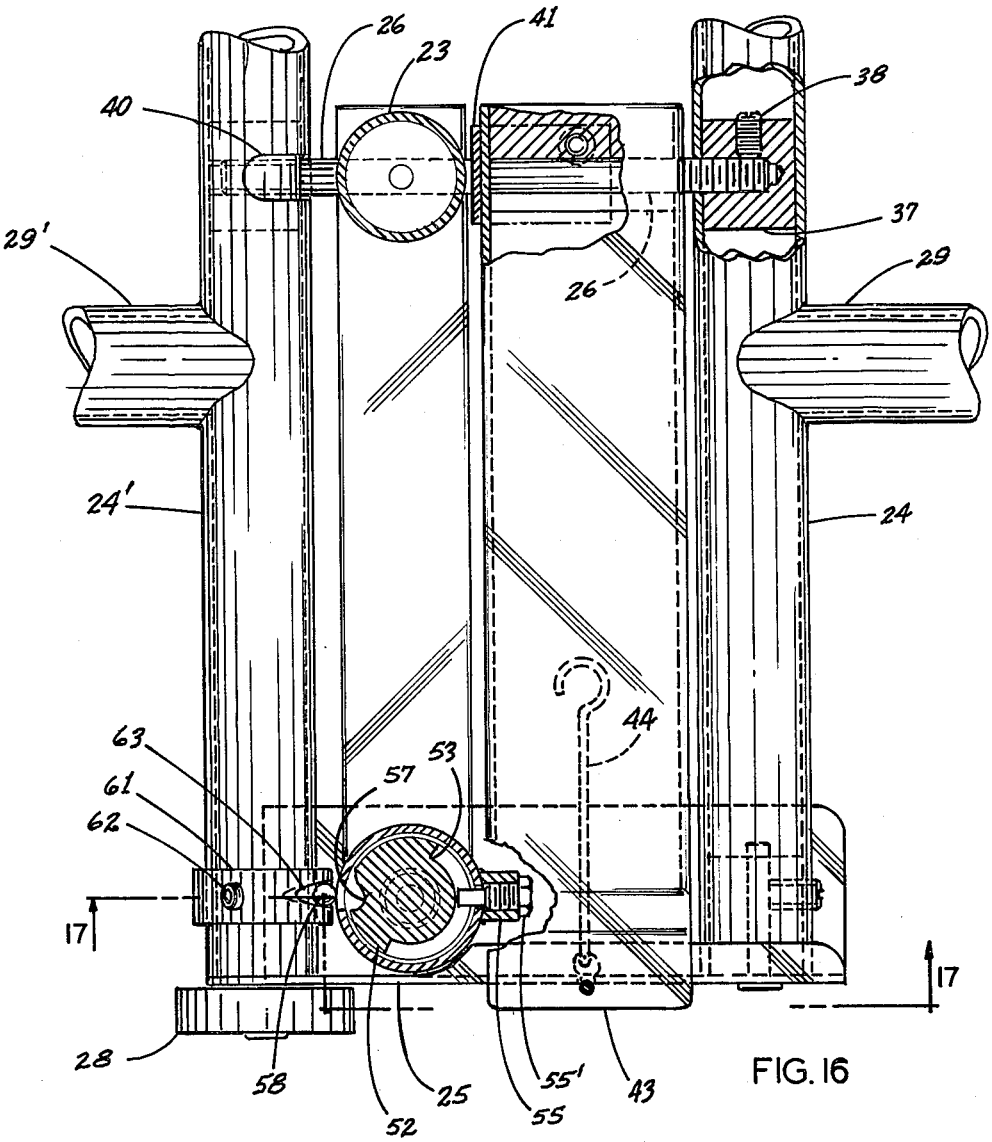
FIG. 16 is a horizontal cross-section of certain base and support members with elements partly broken away for illustration, as taken generally along line 16—16 of FIG. 9.
Figure 17:
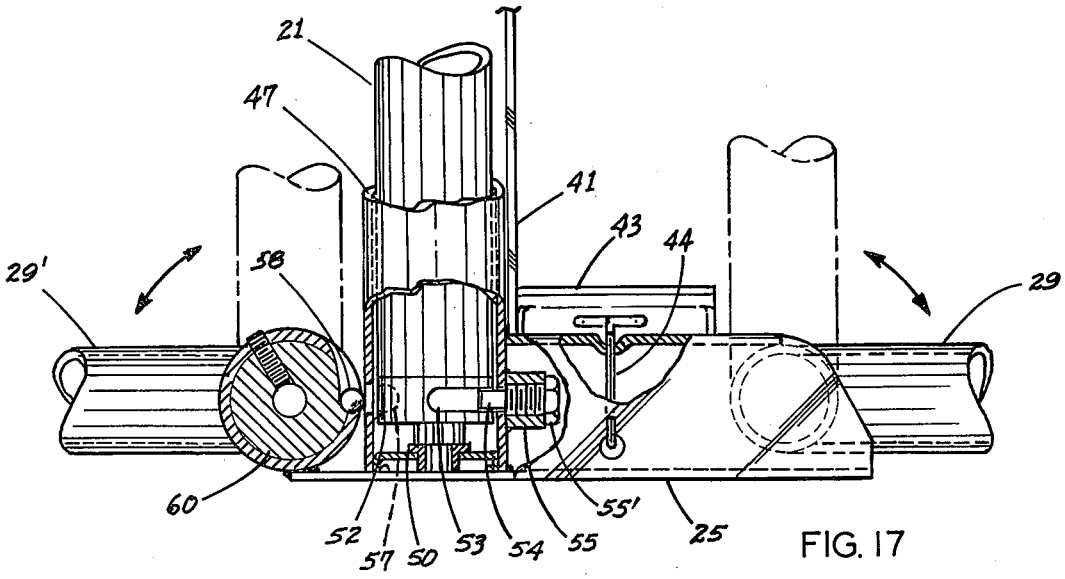
FIG. 17 is a vertical cross-section, partly broken away, of portions of certain base structure, as taken generally along line 17—17 of FIG. 16.

In the rear end of the base, and secured to member 25, is a tubular member 47 of several inches in height in which is rotatably affixed tubular support 21. The features of this arrangement are best depicted in FIGS. 16 and 17 wherein it is apparent that member 25 is of bracket-like angle material and with tubular member 47 being welded to the lower end. At the upper end, member 47 is provided with a sleeve bearing, as at 48, for journaling member 21 for rotation. A thrust bearing 50 is located within member 47 at the lower end for receiving the seat upon member 21. This bearing 50 has seated upon it a plug 52 fitted at the lower end of member 21.

Plug 52 is arcuately slotted at 53 to receive a screw 54 seated within an extension 55 for the purpose of limiting the rotation of member 21 within member 47. Also provided in plug 52 is a recess 57 for receiving a ball detent 58 located on the side opposite screw 54. This ball is seated in recess 57 during storage movement of the ironer as described below. For this purpose, a plug 60 is fitted into member 24' and defines, together with a ring 61 affixed by a set screw 62, an inclined seat or recess 63 for camming ball 58 into recess 57 upon clockwise rotation of member 24' as viewed in FIG. 17.

Figure 9:
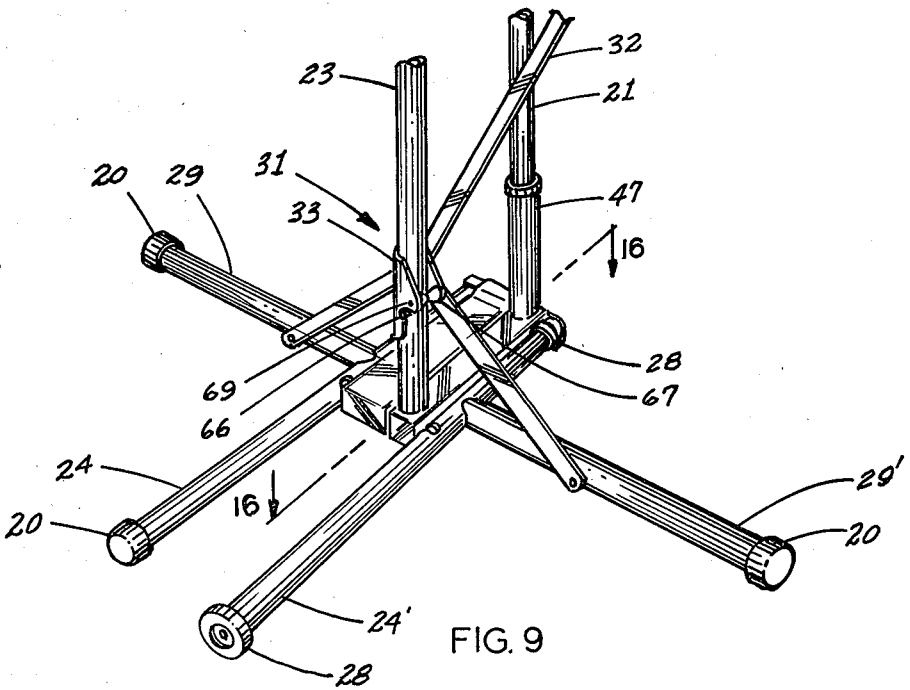
FIG. 9 is an enlarged perspective view, again of a fragmentary nature but from another location, showing certain features of base and support elements of the apparatus.
Figure 8:
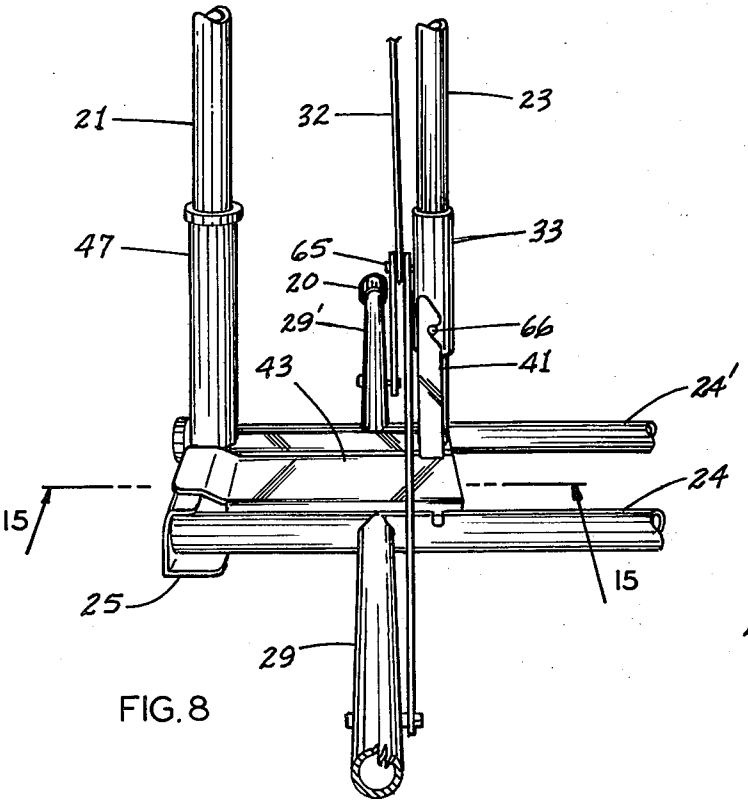
FIG. 8 is an enlarged fragmentary perspective view of base and support elements of the invention.
Figure 11:
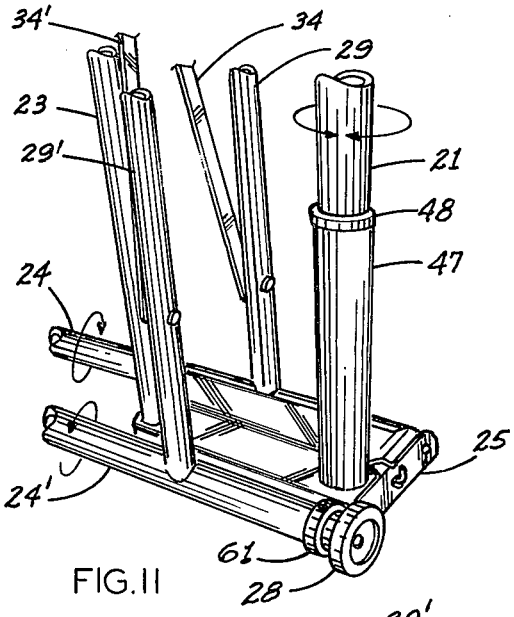
FIG. 11 is an enlarged fragmentary perspective view of portions of base and support elements, and with leg members retracted.
Figure 12:
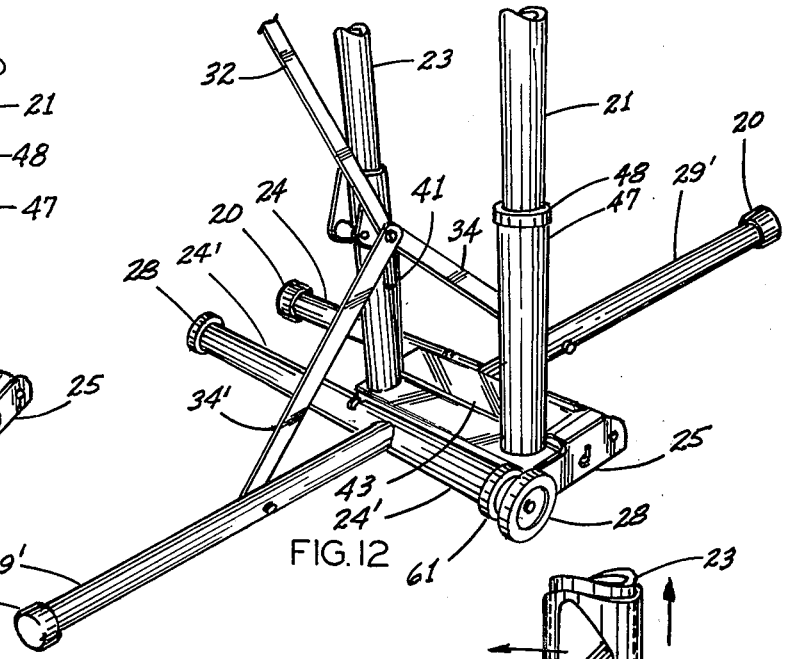
FIG. 12 is a perspective view similar to FIG. 11 but illustrating the leg members extended.
Figure 15:
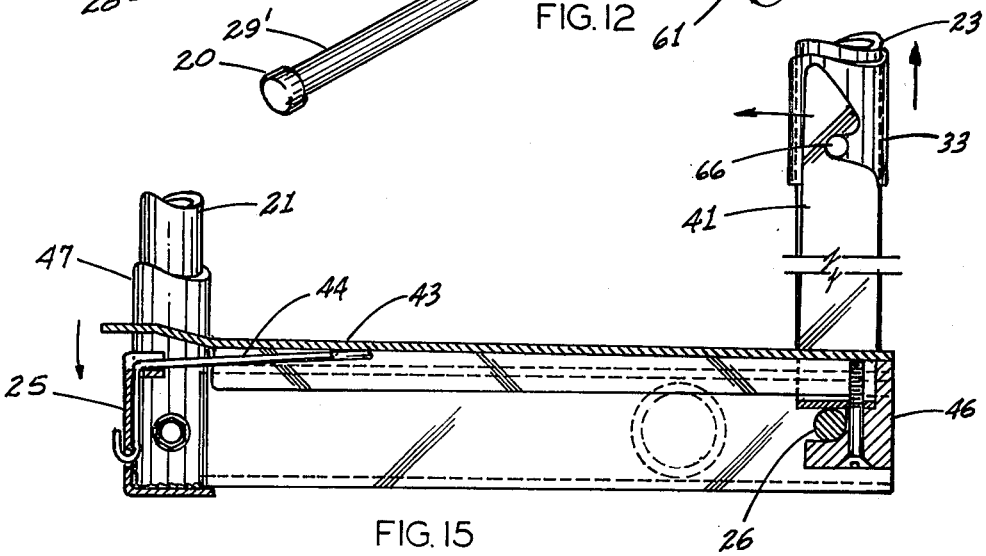
FIG. 15 is a vertical cross-section of portions of the base, as taken generally along line 15—15 of FIG. 8.
Figure 13:
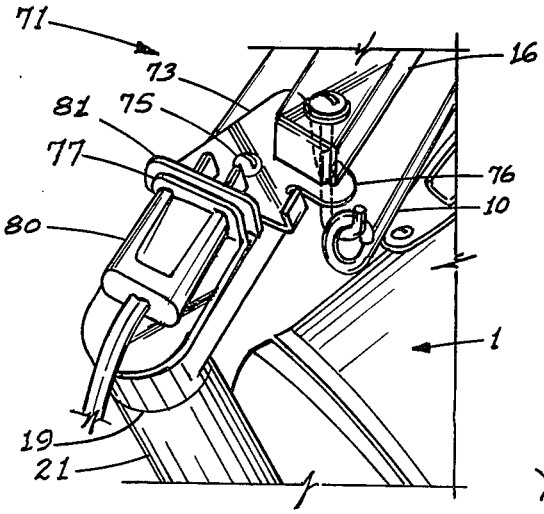
FIG. 13 is an enlarged perspective view of the attachment of a certain iron support arm and associated structure including a feature for ensuring proper latching of components for storage.
Figure 14:
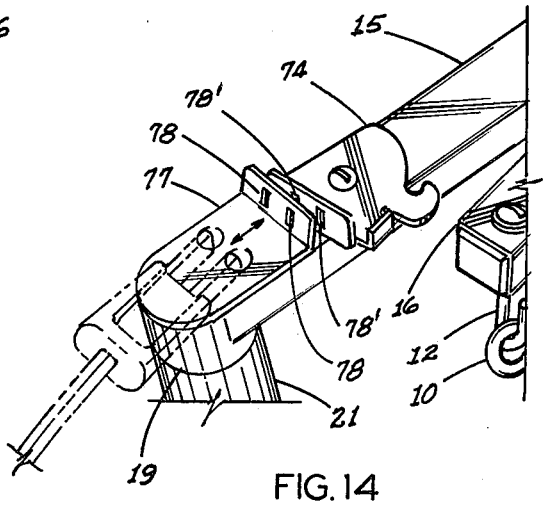
FIG. 14 is a similar perspective view illustrating further aspects of the elements shown in FIG. 13.

When the ironing board is in use position, sleeve 33 is locked in its lower position by latch member 41. Links 32 and 34, 34' are all connected to sleeve 33 at a single stub shaft 65 (FIG. 8). This sleeve includes also a latch pin 66 which latch member 41 engages by a suitable shoulder. (See particularly FIG. 8.) For permitting sleeve 33 to ride smoothly upon member 23, an hourglass-shaped roller 67 is provided for rolling engagement with member 23 (FIG. 9). Downward movement of sleeve 33 is limited by a pin 69 (FIG. 9) to precisely orient sleeve 33 in its locked lower position for rigidly securing legs 29, 29' in their extended orientation.

When the user exerts foot pressure on release lever or plate 43, latch member 41 clears pin 66 to permit sleeve 33 to slide upwardly on member 23 for movement of the ironing board to its storage position and with corresponding rotation of legs 29, 29' to their retracted positions. Therefore, the operator need not bend over to reorient the ironing apparatus for storage consistent with an overall design philosophy of facilitating the task of ironing in every possible way.

As viewed in FIG. 6, ironing board 2, when thus released, is rotated or swung counterclockwise. Ironing board 2 will continue rotating counterclockwise until it reaches a vertical position at which it stops on dead center and with legs 29, 29' being vertical. Further, for compact storage, arms 15, 16 are oriented as shown in FIG. 3 proximate the bottom surface of ironing board 2 and with iron 1 being located proximate the upper end of upright member 21 while remaining suspended by rod 10 and safely out of contact not only with the ironing board surface but also any other structure. Accordingly, there is no fire hazard or danger of harmful contact of iron 1 with adjacent materials or surfaces. This permits the apparatus to be configured for storage without waiting for the iron to cool off.

As discussed previously, rotation of member 21 is limited by slotted plug 52. Therefore, arm member 15 may be reoriented to a position shown in FIGS. 1–3 and with further movement being limited by the engagement of screw 54 in slot 53. Further, the slot provides a limit for rotation of arm 16 during use of the iron, stopping the arm from rotating before it comes into alignment with arm 15 and, thus, preventing the arms from doubling back as would interfere with ironing and reorientation for storage.

When the ironing board is reoriented for storage, rotation of base member 24' cams ball detent 58 into recess 57 assuming that arm 15 has been first moved to its storage position, as in FIGS. 1–3. The ball detent locks member 21 against further rotation to prevent the iron support arms from swinging when the ironer is tipped on its base and rolled, by means of rollers 28, to or from a storage location.

Referring to FIGS. 19 and 20, there is illustrated a mechanism 71 for securely retaining linkage in its storage position with arms 15, 16 folded back on one another as shown in FIGS. 6 and 7. Located atop arm 15 near its connection 19 with member 21 is a latch 73 pivotally connected as by a screw 75 to the upper surface of arm 15. Latch 74 includes a finger 76 located for engaging hook 12 when arm 16 is swung back against arm 15. A spring (not shown) beneath latch 74 suitably biases it for counterclockwise movement about pivot 75 to maintain finger 76 in contact with the shank of hook 12. Further, a fitting providing a flange 77 having a pair of slots 78 is affixed to arm 15 rearwardly of latch 74. The slots are spaced for receiving the prongs 79 of the iron plug 80 for storage. Latch 74 is similarly provided with a flange 81 having corresponding slots 78'. The geometry of latch 74 is such that slots 78, 78' will come into registry only when hook 12 is engaged by finger 76. Thus, plug 80 cannot be inserted for storage until latch 74 is secured but, when so inserted, plug 80 effectively locks latch 74 in place. Latch 74 securely maintains the storage orientation of the arms of linkage 11 when apparatus is being moved.

Referring now to FIGS. 18–21, the features of securement device or unit 9 by which iron 1 is supported from linkage 11 and interengaged therewith are specifically illustrated. Unit 9 permits the iron to be moved between first and second orientations respectively in and out of contact with the ironing surface 17. In this regard, it is desired to support the iron so that it can exert its weight when touching the surface for effective ironing when moved over the clothes to be ironed so that the ironing is carried out partly by pressure and partly by steam and heat. However, the user may easily effect movement of the iron to its raised position, being assisted substantially. Securement unit 9 comprises a piece 82 of sheet metal formed, as by bending, to provide a channel section configuration providing an upper portion **82*a* of U-shaped cross section having side flanges 83, 83' and hingedly secured a lower portion 82*b* wherein the flanges are tapered to diminish in height toward the lower end for conformance with the conventionally tapered handle portion 6 of the iron. Flanges 83, 83' extend forwardly at right angles from a flat rear wall 84 which is secured easily and simply to handle portion 6 by a screw 85** which may take the place of one conventionally part of the iron.

The lower end of rod 10 is suitably affixed to portion **82*a* which similarly includes a pair of forwardly extending flanges 86, 86' which are spaced just outwardly of flanges 83, 83' and are hingedly secured thereto by a transverse pin 87 extending through all four flanges, whereby rod 10 and element 82 are pivoted to permit relative movement with the rod remaining always within a plane vertically bisecting the iron. It is noted that unit 72, and thus rod 10, extends upwardly from the iron in near alignment with the power cord 89** without interference with same.

Figure 21:
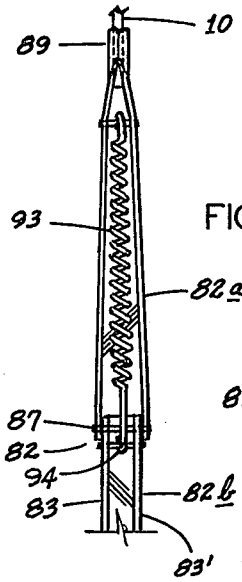
FIG. 21 is a view of a portion of the alternative securement device as seen from the direction opposite from that of FIG. 20.

Fitting portion **82*a* is connected by a pin 87 to portion 82*b* and with portion 82*a* having its upper end crimped and appropriately brazed or welded, etc. to the lower end of rod 10, as at 89. Pin 87 is horizontal and located above iron handle 5 whereby portions 82*a*, 82*b* form an angular relationship depicted in FIG. 18 when the iron is raised, with said fitting lying near the top surface of handle 5 and with sufficient space provided between it and the handle for insertion of the user's hand. Pin 87 is located such that when iron 1 is lowered into position for ironing, portion 82*a* and 82*b* come into substantial alignment and with slightly overcentered relationship with a lower edge 91 of portion 82*a* contacting the rear surface of the upper end of fitting portion 82*b*. Portions 82*a* and 82*b* are interconnected by coiled tension spring 93 having one end hooked across a pin 94 at the iron-remote end of member 89 and the other end hooked to a pin 94 located just below pivot pin 87 whereby the axis of spring 93 lies close to pin 87 when the iron is lowered, as in FIG. 22, yet can exert increased leverage for maintaining the iron in a raised position, as shown in FIG. 21**.

Thus, as the iron is lowered into contact with ironing surface 17, the effective lever arm becomes less and less and with the iron pressing with a substantial portion of its weight upon the articles being ironed and with additional weight being applicable by pressure of the operator's hand. Thus, the iron securement unit demonstrated in FIGS. 18–21 provides a significant advantage with respect to movement of the iron from its raised to its horizontal position and subsequent return to its raised position. Since the axis of spring 93 moves into alignment with the hinge axis defined by pin 87, the weight of the iron is transferred to the articles undergoing ironing.

It is preferred that the height of the linkage and length of rod 10 be such that the iron occupies its horizontal position a short distance, such as about ½ inch, before touching the ironing surface 17 so that the iron will drop under its own weight the remaining small increment of an inch to the ironing surface, being thus no longer substantially under the influence of spring 93. For raising the iron, the user when lifting the iron will produce rotation about pin 87, rocking the iron upon its heel which thus serves as a fulcrum enabling the iron to be lifted easily. As the sole plate 3 of the iron begins to form an angle to the horizontal, spring 93, being pretensioned, begins increasingly to exert its influence by effective increase of the lever arm relative to pin 87, so that the iron seems to lift itself without substantial effort. This greatly minimizes the tiresome application of lifting forces and provides hitherto unachieved ease of ironing by making it possible to reposition the iron while it is fully supported by the new ironing apparatus.

This arrangement also provides a reduced height permitting the overall apparatus to be lower than otherwise possible while still making the iron readily accessible for movement between its raised and lowered positions yet without blocking the operator's view of the iron as requisite for most efficient use.

It is to be noted that ironing board 2 is pointed at only one end, being that which would be to the left of the user when the iron is in use position as preferred if the user is right-handed. The new iron support arrangement permits, however, the iron to be easily relocated from its position shown, (wherein the iron also points to the left) to an opposite direction, as a left-handed individual would prefer. Of course, the apparatus could be manufactured with the elements reversed or with the ironing board attached so that its pointed end would be to the right of the user, e.g., as viewed in FIG. 6.

The new apparatus provides the user with hitherto unobtainable ease of ironing but also permits the apparatus to be taken from storage and rapidly reoriented for use. Upon completion of ironing, the user may just as quickly return the apparatus to its storage orientation, even while the iron is still hot. Then, the apparatus can be returned to a closet or other storage location, being very compact and occupying storage space scarcely more than would be required for a separate iron and conventional ironing board.

In view of the foregoing, it will be seen that the various objects of the invention and other advantageous results are obtained.

Although the foregoing includes a description of the best mode contemplated for carrying out the invention, various changes and modifications are contemplated.

Since it is understood that changes and modifications in the formation, construction, arrangement, and combination of the various parts of the ironing apparatus of this invention may be made and substituted for those herein shown and described without departing from the nature and principles of this invention. The description, accordingly, shall be interpreted as illustrative rather than limiting.

What is claimed is:

1. Compact, collapsible ironing apparatus comprising a base (20) providing supportive disposition upon a supporting surface for carrying an ironing board (17) and for supporting a hand iron (1) above the ironing surface of said ironing board, said base comprising a first upright member (23) extending upwardly therefrom and means (36) pivotally securing said ironing board to the upper end of said first upright member for swingable movement upon a pivot axis between storage and use positions, and a second upright member (21) extending upwardly from said base, an iron support linkage (15, 16) swingably interconnected at one end to the upper end of said second upright member and extendable to positions over said ironing surface, and iron securement means (9) pivotally interconnecting the other end of said support linkage with said iron for permitting movement of said iron between first and second orientations, respectively, in and out of contact with said ironing surface, said base comprising folding support members (32, 34, 34') movable between storage and use positions conjointly with swinging movement of said ironing board between its respective storage and use positions, said folding support members of said base comprising leg members (29, 29') swingably affixed for movement between respective raised positions for storage and extended positions for use, said extended positions providing increased area of contact of said base with said supporting surface, said leg members being affixed at opposite sides of said base and when in respective extended positions projecting in opposite directions from said base.

2. Ironing apparatus according to claim 1 and further characterized by said ironing board being swingable on a horizontal, transversely oriented pivot axis between vertical and horizontal orientations, respectively, constituting said storage and use positions thereof, said pivot axis being above said base and positioned laterally between said leg members, said leg members when extended underlying said ironing board being substantially aligned with the longitudinal axis thereof.

3. Ironing apparatus according to claim 2 and further characterized by said leg members each being swingable in a vertical plane on a horizontal, transversely oriented pivot axis, and each leg member being interconnected by a swing control linkage with said ironing board.

4. Ironing apparatus according to claim 3 and further characterized by said base comprising a frame, first and second tubular support members each pivotally mounted by said first and second upright members, said first and second tubular members extending transversely to the longitudinal axis of said ironing board, each leg member constituting a radial extension of a respective tubular support member.

5. Ironing apparatus according to claim 3 and further characterized by one of said upright members including a sleeve slidable thereon, said swing control linkage comprising first and second links interconnecting said sleeve with each of said leg members for movement of the latter with sliding of said sleeve, and a third link interconnecting one of said links with said ironing board for causing sliding of said sleeve with swinging of said ironing board, and latch means for latching said sleeve in a position in which said ironing board is horizontally disposed and said leg members are each extended.

6. Ironing apparatus according to claim 5 and further characterized by said base including foot-operated latch control means for selectively releasing said latch means to permit swinging of said ironing board to vertical disposition and swinging of said leg members to a raised position.

7. Ironing apparatus according to claim 1 and further characterized by said iron support linkage comprising articulated first and second arm members each swingable within a horizontal plane above said ironing surface, said iron support linkage comprising a first arm member secured to and radially extending from the upper end of said second upright member, said second upright member being rotatably connected to said base, said second arm member being swingably pivoted to said first arm member and having a distal end supporting said iron, said first and second arm members being swingable into positions folded upon one another for storage with said iron supported proximate said second arm members adjacent said ironing board when vertically dispositioned for providing said storage position thereof.

8. Ironing apparatus according to claim 7 and characterized by means responsive to folding of said folding support members for locking rotation of second upright member, and means for retaining said first and second arm members in folded orientation.

9. Ironing apparatus according to claim 7 and further characterized by said iron securement means comprising a unit for attachment to said iron, and a support arm extension providing interconnection of said unit and a distal end of said second arm member, said iron being rotatable with respect to said support arm extension for movement between said first and second orientations.

10. Ironing apparatus according to claim 9 and further characterized by spring means interengaging said unit and said support arm extension, said spring being pretensioned and oriented for exerting increasing leverage as said iron is moved from said first to said second orientation and for maintaining said iron in said second orientation.

11. Compact, collapsible apparatus comprising a base (22) providing supportive disposition upon a supporting surface for carrying an ironing board (17) and for supporting a hand iron (1) above the ironing surface of said ironing board, said base comprising a first upright member (23) extending upwardly therefrom and means (36) pivotally securing said ironing board to the upper end of said first upright member for swingable movement upon a pivot axis between storage and use positions, and a second upright member (21) extendingh upwardly from said base, an iron support linkage (15, 16) swingably interconnected at one end to the upper end of said second upright member and extendable to positions over said ironing surface, and iron securement means (9) pivotally interconnecting the other end of said support linkage with said iron for permitting movement of said iron between first and second orientations respectively in and out of contact with said ironing surface, said base comprising folding leg members (29, 29') swingably movable between extended storage and retracted use positions conjointly with swinging movement of said ironing board between its respective storage and use positions, said leg members being affixed at opposite sides of said base and when in respective extended positions projecting in opposite directions from said base, said ironing board being swingable on a horizontal, transversely oriented pivot axis between vertical and horizontal orientations, respectively, constituting said storage and use positions thereof, said pivot axis being above said base and positioned laterally between said leg members, said leg members when extended underlying said ironing board being substantially aligned with the longitudinal axis thereof, each said leg member being interconnected by a swing controllinkage (32, 34, 34') with said ironing board, said iron support linkage comprising articulated first and second arm members (15, 16) each swingable within a horizontal plane above said ironing surface, said first arm member (15) radially extending from the upper end of said second upright member and swingable therefrom, said second arm member (16) being swingably pivoted to said first arm member and having a distal end supporting said iron, said iron securement means comprising a unit (9) for attachment to said iron, and a support arm extension (10) rotatably interengaging said unit, said support arm extension providing interconnection of said unit and a distal end of said second arm member, said iron being rotatable about a shaft portion thereof for movement between said first and second orientations.

12. An ironing apparatus according to claim 11 and further characterized by said unit including a first member (82*b*) for rigid attachment to said iron and a second member (82*a*) connected at one end to said first member in pivotal relationship for permitting said iron to pivot between said first and second orientations, said second member being connected at its other end by a rod-like member (10) with the distal end of said first arm member, and a spring (93) interengaging said first and second members, said spring exerting leverage between said first and second members for maintaining said iron in said second orientation, said spring being disposed for providing decreasing leverage for support of said arm as said iron is pivoted toward said first orientation.

* * * * *

UNITED STATES PATENT OFFICE

CERTIFICATE OF CORRECTION

Patent No. 4,433,497 Dated February 28, 1984

Inventor(s) Edwin E. Foster et al

It is certified that error appears in the above-identified patent and that said Letters Patent are hereby corrected as shown below:

Claim 7, column 10, line 32, after "second" insert ---upright member in a stored position, with said first and second---.

Claim 11, column 10, line 55, after "collapsible" insert ---ironing---; same claim, line 64, delete "extendingh" and insert ---extending---; same claim, column 11, line 20, delete "controllink-" and insert ---control link- ---.

Signed and Sealed this

Fifth Day of June 1984

[SEAL]

Attest:

GERALD J. MOSSINGHOFF

Attesting Officer

Commissioner of Patents and Trademarks